US007411359B2

(12) United States Patent
Chung et al.

(10) Patent No.: US 7,411,359 B2
(45) Date of Patent: Aug. 12, 2008

(54) APPARATUS AND METHOD FOR PROVIDING DIMMING CONTROL OF LAMPS AND ELECTRICAL LIGHTING SYSTEMS

(75) Inventors: Shu-hung Henry Chung, Kowloon (HK); Ngai Man Ho, Kowloon (HK); Shu-Yuen Ron Hui, Kowloon (HK)

(73) Assignee: e.Energy Double Tree Limited, Hong Kong (CN)

( * ) Notice: Subject to any disclaimer, the term of this patent is extended or adjusted under 35 U.S.C. 154(b) by 73 days.

(21) Appl. No.: 10/569,588

(22) PCT Filed: Aug. 26, 2004

(86) PCT No.: PCT/CN2004/000990

§ 371 (c)(1),
(2), (4) Date: Oct. 10, 2006

(87) PCT Pub. No.: WO2005/022952

PCT Pub. Date: Mar. 10, 2005

(65) Prior Publication Data

US 2007/0057640 A1 Mar. 15, 2007

(30) Foreign Application Priority Data

Aug. 27, 2003 (GB) ..... 0320067.2

(51) Int. Cl.
*G05F 1/00* (2006.01)

(52) U.S. Cl. ..... 315/291; 315/194; 315/209 R; 315/247; 315/DIG. 4

(58) Field of Classification Search ..... 315/291, 315/194, 209 R, 219, 247, DIG. 4, DIG. 7, 315/307

See application file for complete search history.

(56) References Cited

U.S. PATENT DOCUMENTS

| | | | | |
|---|---|---|---|---|
| 4,350,935 | A | 9/1982 | Spira et al. | 316/291 |
| 4,437,043 | A | 3/1984 | Pitel | 315/308 |
| 5,144,205 | A * | 9/1992 | Motto et al. | 315/244 |
| 5,389,857 | A | 2/1995 | Abbott et al. | 315/94 |
| 5,432,406 | A | 7/1995 | Brooks | 315/94 |
| 5,519,289 | A * | 5/1996 | Katyl et al. | 315/224 |
| 5,757,145 | A | 5/1998 | Johnson et al. | 314/308 |
| 5,949,196 | A | 9/1999 | Lesea et al. | 315/240 |
| 6,121,734 | A | 9/2000 | Szabados | 315/291 |
| 6,218,787 | B1 * | 4/2001 | Murcko et al. | 315/194 |

(Continued)

OTHER PUBLICATIONS

Persson, et al., "A performance comparison of electronic vs. magnetic ballast for power gas-discharge UV lamps," Rad Tech' 98, Chicago, 1998, pp. 1-9.

*Primary Examiner*—Haissa Philogene
(74) *Attorney, Agent, or Firm*—Heslin Rothenberg Farley & Mesiti P.C.

(57) ABSTRACT

Dimming of an electrical lamp of the type driven by a ballast is provided by a reactive power device in series between the AC supply and the ballast. The reactive power device provides a variable auxiliary voltage out of phase by 90 or 270 degrees with the current such that a smaller magnitude voltage is applied to the lamp. The dimming device has a switch to enable/disable dimming. When the switch is enabled, the voltage applied to the lamp is controlled by a half-bridge inverter with a pair of totem pole power electronic switches, along with a pair of DC series capacitors and a low-pass filter.

28 Claims, 11 Drawing Sheets

U.S. PATENT DOCUMENTS 6,271,635 B1 8/2001 Daniel ..... 315/277
6,486,615 B2 * 11/2002 Hui et al. ..... 315/291
6,538,395 B2 3/2003 Szabados ..... 315/291
6,545,431 B2 * 4/2003 Hui et al. ..... 315/291
6,639,369 B2 10/2003 Ribarich ..... 315/307

* cited by examiner

APPARATUS AND METHOD FOR PROVIDING DIMMING CONTROL OF LAMPS AND ELECTRICAL LIGHTING SYSTEMS

CROSS-REFERENCE TO RELATED APPLICATIONS

This application is a 35 U.S.C. §371 filing of International Application No. PCT/CN2004/000990, filed Aug. 26, 2004 and published in English as WO/022952 A2 on Mar. 10, 2005; which claims the benefit of United Kingdom Patent Application No. GB0320067.2 filed on Aug. 27, 2003, each of which are incorporated herein by reference in their entirety for all purposes.

TECHNICAL FIELD

This invention relates to apparatus and methods for providing dimming control of individual electrical lamps or more generally electrical lighting systems including systems formed of a plurality of individual lamps. The invention relates in particular to a simple general purpose and non-intrusive dimming system that can be retro-fitted to existing lamps and which is non-intrusive in the sense that when not in use the dimming apparatus has no effect on the normal operation of the lamp.

BACKGROUND OF THE INVENTION

A wide range of different types of lamps and lighting systems are used in various different applications. These include fluorescent lamps, high energy discharge lamps and gaseous discharge lamps. A general drawback to such lamps, however, is that in general terms they are considered to be "non-dimmable", that is to say they tend to have a fixed power output and are of a certain defined brightness and intensity. Generally speaking this is not desirable because the light can often be too bright and harsh, and can be wasteful on power.

For both aesthetic and energy conservation reasons, therefore, various attempts have been made in the prior art to provide such lamps with a dimming control capability so that the brightness of the lamps can be adjusted.

PRIOR ART

Existing dimming methods for existing lighting systems include Triac-based dimmers for incandescent lamps and gaseous discharge lamps compatible with triac dimmers, dimmable electronic ballasts for discharge lamps, and a range of disparate techniques for dimming lamps driven by magnetic ballasts. These prior art techniques will be discussed in turn.

Edison-type incandescent lamps have been used for a long time. Incandescent lamps do not have an in-built dimming capability and in order to control the light intensity of the incandescent lamps, triac dimmers have been used as the dimming devices as illustrated in FIG. 1(*a*). A triac dimmer conventionally consists of two thyristors connected in anti-parallel configuration and also a triggering circuit which can control the delay angle for turning on the appropriate thyristor in the relevant half-cycle of the mains voltage. As shown in FIG. 1(*b*), by controlling the delay firing angle ($\alpha$), the voltage content of the mains voltage can be controlled as the output voltage of the triac dimmer and applied to the incandescent lamp and some triac-compatible compact fluorescent lamps (CFL). However, because the mains input current through the triac dimmer is affected by the shape of the triac dimmer's output voltage, when the delay firing angle is not zero the input current will deviate from the sinusoidal shape of the mains voltage, resulting in power line harmonics. This high current harmonic content is an inherent problem of lighting systems controlled by triac dimmers, especially when the delay angle is large.

FIG. 1(*c*) shows a power flow diagram in the triac-dimmer controlled lighting system. The triac dimmer circuit has to handle both the real power (P) and the reactive power (Q) of the lighting devices or systems. Thus, its voltage-current (VI) ratings must be large enough to handle the full power of the lighting systems. Two examples of triac based dimmers are described in U.S. Pat. No. 4,437,043 and U.S. Pat. No. 5,757,145.

Recently, there has been an increasing trend of using dimmable electronic ballasts for discharge lamps such as fluorescent lamps and high-intensity-discharge (HID) lamps. The schematic of dimmable electronic ballasts for discharge lamps is shown in FIG. 2. A dimmable electronic ballast usually has a 4-wired connection arrangement on the input side. Two connections are for the "live" and "neutral" of the ac mains, the other two are for the DC dimming level control signal, which is normally set to be within 1V to 10V.

A dimmable electronic ballast is essentially a power converter that controls the power flow to the lamps. Conventional dimmable electronic ballasts dim the lamp by increasing the switching frequency of the ballast inverter. The impedance of the inductor that limits the current to the lamp will increase with operating frequency, and thus the lamp power can be controlled by controlling the inverter frequency.

As with a triac dimmer, a dimmable electronic ballast is conventionally connected between the ac mains voltage and the lighting load. Thus, existing dimmable electronic ballasts have to handle the full power (both real power P and reactive power Q) of the lighting load. The power capability of the ballast must therefore be higher than sum of the full lamp power and the electronic loss.

As shown in FIG. 1(*c*) and FIG. 2, the power flow diagrams indicate that existing dimming devices or circuits need to handle both the real power and the reactive power. It is therefore not economical to use a single dimming device based on these methods to dim a lighting system formed of a large group or network of lamps. A triac dimmer is typically limited to a few hundreds of watts and dimmable electronic ballasts are usually designed for one or a pair of discharge lamps only.

Magnetic ballasts have a longer history than electronic ballasts. They have been used widely for both fluorescent lamps and high intensity discharge (HID) lamps. Unlike electronic ballasts that operate at high frequency (>40 kHz typically), magnetic ballasts operate at the mains frequency (50 Hz or 60 Hz).

Magnetic ballasts have several advantages over electronic ballasts. These advantages include extremely high reliability and long lifetime (>15 years typically without replacement), robustness against transient voltage surge (e.g. due to lightning) and hostile working environment (e.g. high humidity and temperature). In particular, magnetic ballasts offer superior lamp-arc stability performance in HID lamps, which have a well-known problem of acoustic resonance when the HID lamps are operated with high-frequency electronic ballasts. This is the reason why HID lamps market is dominated by magnetic ballasts, which operate at mains frequency and will not trigger acoustic resonance in the HID lamp arc.

The major limitation of most of the magnetic ballasts is their inability to dim the discharge lamps. Several techniques have been reported to try and get round this problem and to provide dimming magnetic ballasts.

One prior proposal involves tapping the ac mains transformer to achieve a magnitude change in the mains voltage. Theoretically, discharge lamps driven by magnetic ballasts can still be dimmed by manually tapping the mains transformer in order to reduce the mains voltage. However, this is a mechanical solution and is not a suitable dimming solution, particularly when the dimming process must be centrally or automatically controlled. U.S. Pat. No. 6,271,635 describes the use of a two-windings autotransformer for achieving a 2-level dimming system for discharge lamps. The two windings provide two separate voltage sources. A switch is used to choose either the voltage from one set of winding or the full voltage from two sets of windings connected in series. Such 2-level dimming system can be used for a plurality of lamps, but the dimming level is discrete and is not continuous. Persson et al ("A performance comparision of electronic vs. magnetic ballast for power gas-discharge UV lamps", Rad Tech' 98, Chicago, pages 1 to 9, 1998) proposed a multilevel dimming system using a more complicated transformer.

Another possibility is the use of an external current-control power circuit for controlling the current into the magnetic ballast-discharge lamp system. U.S. Pat. No. 6,538,395 and U.S. Pat. No. 6,121,734 disclose the use of an external current-control power circuit that controls the magnitude of the input current to the magnetic ballast driven discharge lamp system. Such an approach controls the lamp power by varying the magnitude of the input current at mains frequency. However, the current-control power stage still has to handle both real and reactive power of the lighting load.

Alternatively, an ac-ac converter such as a cycloconverter (FIG. 3) can in principle be used to create a mains-frequency ac voltage with controllable magnitude to the lighting load consisting of both ballast and lamp. One practical ac-ac voltage converter (U.S. Pat. No. 4,350,935) uses a power converter to chop the AC sinusoidal voltage into voltage pulses with the sinusoidal envelope. However, the ac-ac voltage converter approach (including the use of a cycloconverter and the converter in U.S. Pat. No. 4,350,935) does not generate a sinusoidal voltage for the lighting load. Consequently, lots of current harmonics will be generated in the process, leading to harmonic pollution problems in the power lines. In addition, the power flow representation in FIG. 3 shows that such an approach also requires the ac-ac voltage converter to handle both the real and reactive power. The power rating of the power converter must therefore be higher than the full power of the lighting load.

Several techniques have been reported for dimming magnetic ballasts by varying the impedance in the magnetic ballast system. U.S. Pat. No. 5,389,857 discloses the use of a 2-step inductor as the choke in the magnetic ballast. The 2-step inductor consists of two inductors connected in series. With a switch that can by pass one of the two inductors, the inductance of the 2-step inductor can be altered in a discrete manner. The shortcoming of this approach is that continuous dimming levels cannot be achieved.

U.S. Pat. No. 5,432,406 describes the use of a saturable reactor (inductor) in the magnetic ballast that can be dimmed continuously within a limited range. By adding an extra winding to the reactor and injecting a dc current into this extra winding, the magnetic core of the reactor can be saturated. Therefore, the impedance of the inductor in the magnetic ballast can be changed and the lamp current can be altered. However, this method cannot be applied as a general-purpose dimming method to existing magnetic ballasts that have not got the saturable reactor.

U.S. Pat. No. 5,949,196 describes the use of a current draining capacitor for dimming purpose in discharge lamp systems. A switchable capacitor is connected across a discharge lamp. If dimming is required, the capacitor is switched on so that some lamp current will be diverted away from the lamp into the capacitor. In this way, the lamp current and hence the lamp power and lighting intensity can be controlled in a discrete manner. However, continuous dimming levels cannot be achieved in this method.

In the fluorescent lamps (low-pressure discharge lamps) market, electronic ballasts are replacing traditional non-dimmable magnetic ballasts. Operating at high frequency (typically above 20-kHz) electronic ballasts can eliminate the flickering effects of the fluorescent lamps and achieve a higher efficacy than mains-frequency (50 Hz or 60 Hz) operated magnetic ballasts. Therefore fluorescent lamps driven by electronic ballasts consume less energy for the same light output when compared with lamps driven by magnetic ballasts. However, one major weakness of electronic ballasts is the relatively short lifetime. Magnetic ballasts can normally operate over 10 years without replacement and it is rare to have electronic ballasts with such long lifetime. If magnetic ballasts can be made dimmable, the combined features of their long lifetime, high reliability and energy saving can make such "dimmable magnetic ballasts" an attractive solution to low-pressure discharge lamps such as fluorescent lamps.

In the high-pressure lamps such as the high-intensity-discharge (HID) lamp market, magnetic ballasts are still considered to be a more reliable option than electronic ballasts. The reason for this is that HID lamps could suffer from acoustic resonance when they are operated at frequency higher than 1 kHz. Acoustic resonance is due to the power pressure variation in the lamp tube that could trigger various forms of resonance. In order to avoid acoustic resonance, HID lamps are usually operated at low frequency (less than 1 kHz) or very high frequency (>350 kHz-700 kHz). Although some electronic ballasts are being promoted for use with HID lamps, the lamp characteristics change with time and thus lamp stability is not guaranteed when the lamp's ageing effects become significant. Despite the increasing efforts in developing electronic ballasts for HID lamps, magnetic ballasts still dominate the HID lamp market because of their extremely high lamp arc stability, high ballast reliability and low cost. Particularly in the outdoor lighting applications (such as street lamps) in which robustness and high reliability against lightning are important criteria for consideration.

SUMMARY OF THE INVENTION

According to the present invention there is provided apparatus for providing dimming control of an electrical lamp of the type driven by a ballast that is provided between an AC mains supply and the lamp, comprising means located in series between the mains supply and the ballast for inserting an auxiliary voltage, said auxiliary voltage being out of phase with said mains supply, whereby the supply voltage is the vectorial combination of the voltage applied to the ballast and the auxiliary voltage, whereby the voltage applied to the ballast has a magnitude that is smaller than the magnitude of the voltage of the mains supply, and further comprising means for controlling the auxiliary voltage for varying the voltage applied to the lamp, wherein the auxiliary voltage is maintained at 90 or 270 degrees out of phase with the current flowing through said apparatus, and wherein the magnitude of the auxiliary voltage is used for varying the voltage applied to the lamp. This latter feature is advantageous because it ensures that the dimming control apparatus handles only the reactive power, which minimizes real power loss in the dimming control apparatus.

In one preferred embodiment the apparatus comprises a half-bridge inverter including two switches that are switched at high-frequency to generate a pulse-width-modulated (PWM) waveform as an output. Preferably the PWM output of said half-bridge inverter is filtered to provide an auxiliary voltage of a highly sinusoidal character. In this embodiment means are provided to select a desired the DC link voltage for the half-bridge inverter in order to control the magnitude of the auxiliary voltage. In particular means are provided to maintain said DC link voltage at said desired value and to maintain the phase of said auxiliary voltage 90 or 270 degrees out of phase with the current flowing through said apparatus. For example a closed loop control scheme may be used for maintaining said DC link voltage at said desired value and for maintaining the phase of said auxiliary voltage 90 or 270 degrees out of phase with said current.

Preferably switch means are provided whereby the apparatus may be by-passed if dimming control is not required and the voltage of the mains supply is applied directly to the ballast.

Viewed from another aspect the present invention provides an electrical lighting system comprising at least one lamp connected to an AC mains supply through a ballast, said system further comprising means for providing dimming control of said at least one lamp, said dimming control means comprising means located in series between the mains supply and the ballast for inserting an auxiliary voltage, said auxiliary voltage being out of phase with said mains supply, whereby the supply voltage vectorial combination of the voltage applied to the ballast and the auxiliary voltage, whereby the magnitude of the voltage that is applied to the ballast is smaller than the magnitude of the voltage of the mains supply, and further comprising means for controlling the auxiliary voltage for varying the voltage applied to the lamp, wherein the auxiliary voltage is maintained at 90 or 270 degrees out of phase with the current flowing through said dimming control means, and wherein the magnitude of the auxiliary voltage is used for varying the voltage applied to the lamp.

Viewed from a still further aspect the invention also provides a method for providing dimming control of an electrical lamp driven by a ballast, comprising inserting an auxiliary voltage between an AC supply and said ballast, said auxiliary voltage being out of phase with the voltage of said AC supply whereby the supply voltage is the vectorial combination of the voltage applied to the ballast and the auxiliary voltage, wherein the auxiliary voltage is maintained at 90 or 270 degrees out of phase with the current supplied to the ballast.

BRIEF DESCRIPTION OF THE DRAWINGS

Some embodiments of the invention will now be described by way of example and with reference to the accompanying drawings, in which:—

DETAILED DESCRIPTION OF THE INVENTION

The present invention, at least in its preferred forms, provides a highly energy-efficient and non-intrusive dimming method and apparatus for electric lighting systems such as fluorescent and HID discharge lamps powered either by magnetic ballasts or by some electronic ballasts. This method and apparatus can turn existing "non-dimmable" magnetic ballasts-lamp systems into "dimmable" ones with real energy saving. The proposed dimming method achieves the dimming function with a real energy saving by controlling the voltage available to the ballast-lamp system without handling the real power of the lighting system. The concept behind the invention is a new integrated voltage-vector control and reactive-power control concept.

As will be understood from the detailed description to follow, by controlling the reactive power flow to the lighting system, the proposed dimming apparatus inserts a controllable voltage vector to the mains voltage. The resultant voltage available to the ballast-lamp system can thus be controlled. In a preferred embodiment the dimming method and apparatus achieves minimum power loss by handling only reactive power. Therefore, the power rating of the proposed dimming device can be much smaller than the full power rating of the lighting system. This enables the proposed dimming device to dim a high-power lighting systems or a group of lighting devices. Another advantage of the invention its non-intrusive nature. The ballast-lamp system can still function at full power (ie a non-dimming condition) normally even if the proposed dimming apparatus is not operating.

The proposed method and apparatus can be used to dim individual discharge lamps or a network of HID lamps such as street lamps. It can be used for both indoor and outdoor applications.

Figure 1A:
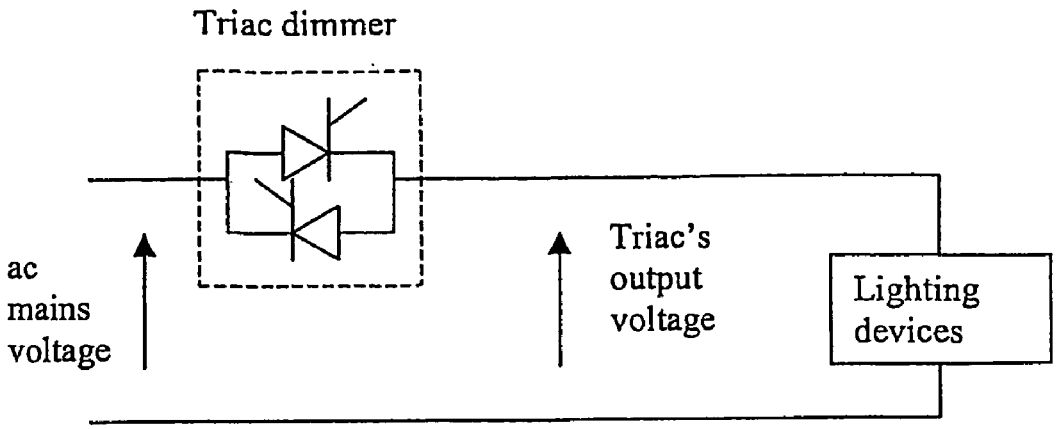
FIGS. 1(*a*)-(*c*) illustrate the operation of a prior art triac based dimmer.
Figure 1B:
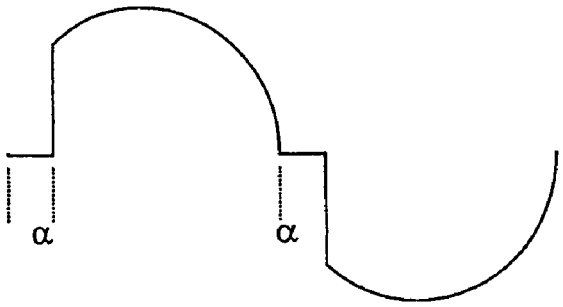
Figure 1C:
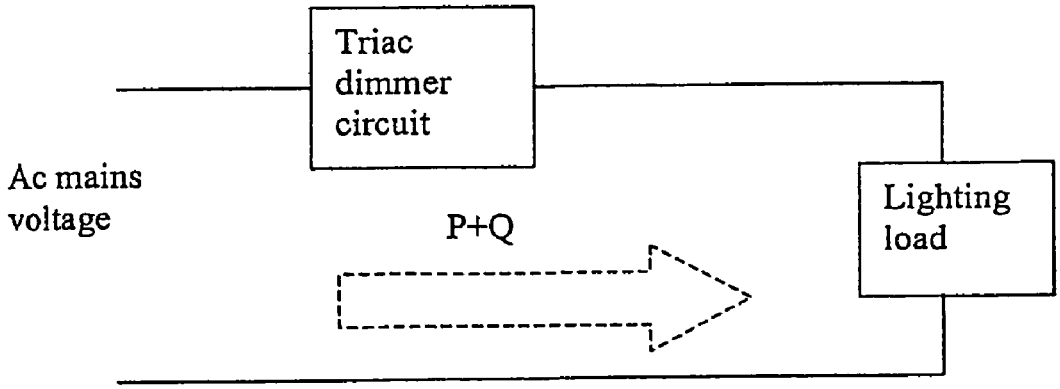
Figure 2:
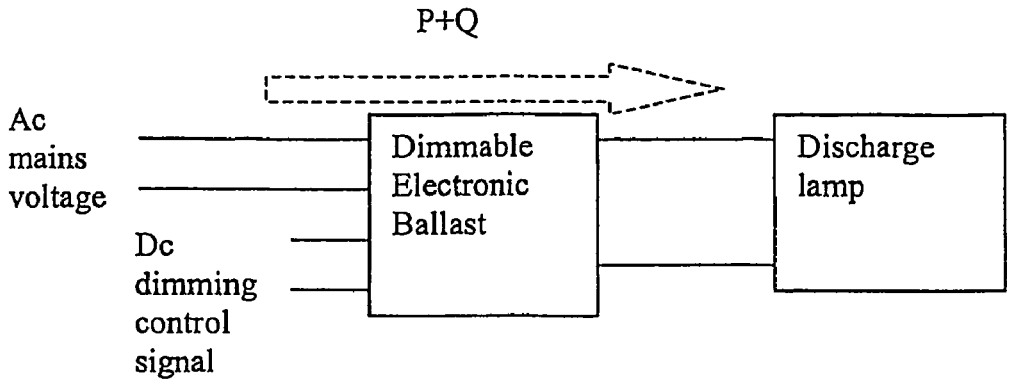
FIG. 2 is a block diagram illustrating a conventional dimmable electronic ballast.
Figure 3:
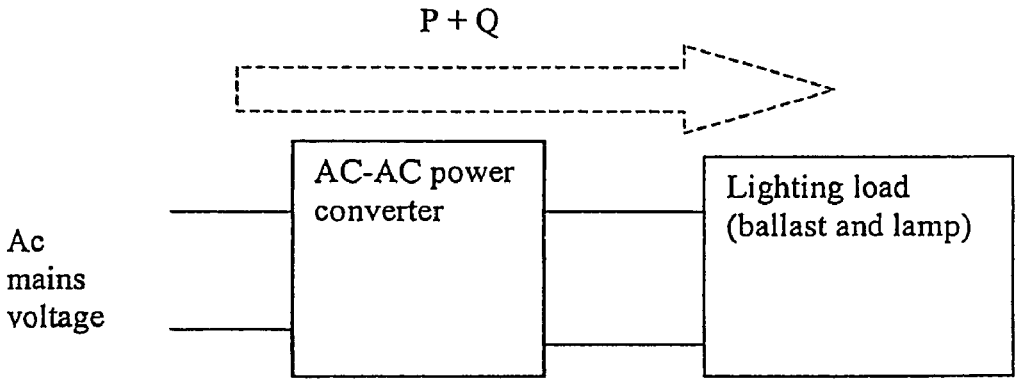
FIG. 3 is a block diagram illustrating the use of an ac-ac converter for dimming control of a magnetic ballast system according to the prior art, FIGS. 4(*a*)-(*c*) show apparatus according to an embodiment of the invention and in particular comprise (a) a block diagram, (b) a schematic illustrating a group pf loads and showing power flow, and (c) the equivalent circuit, FIGS. 5(*a*) and (*b*) are vector diagrams of a discharge lamp system driven by a magnetic ballast (a) without using the dimming control apparatus of the present invention, and (b) with use of dimming control.
Figure 4A:
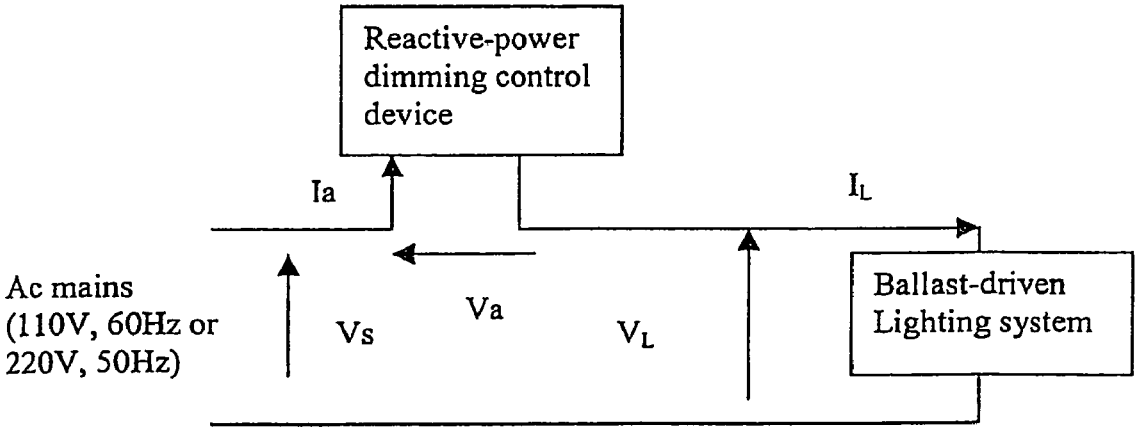
Figure 4B:
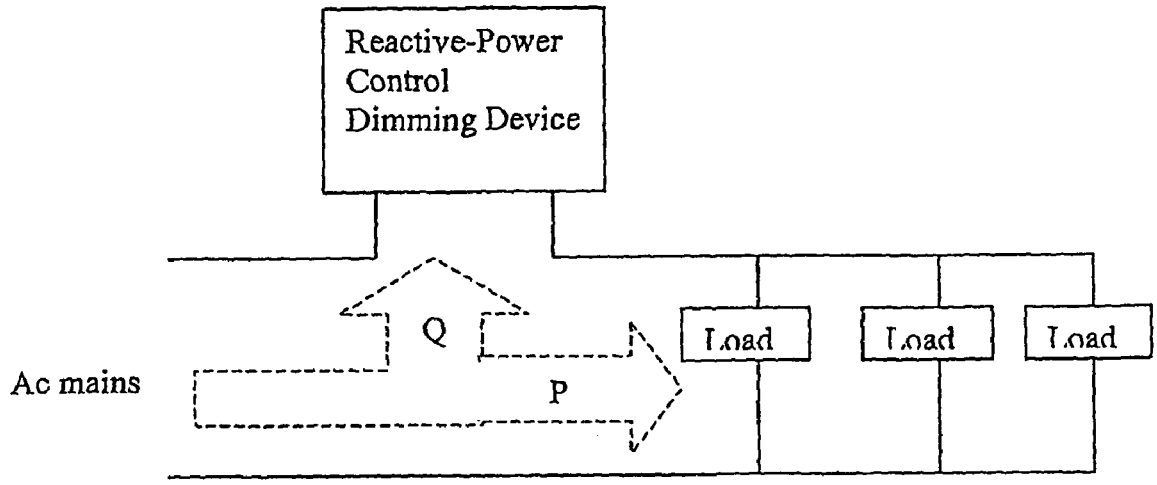
Figure 4C:
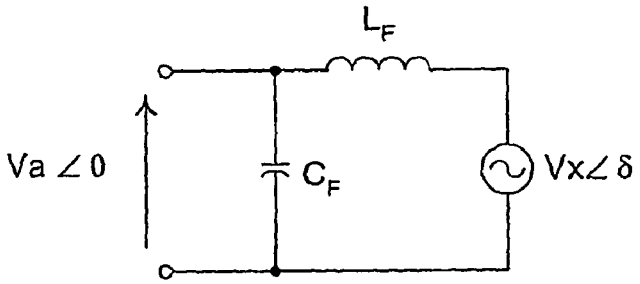

FIG. 4(*a*) shows the basic concept of the integrated voltage-vector control and reactive-power control concept in an embodiment of the invention. In order to dim the lighting system, the ac voltage available to the lighting load is varied without the need for processing the real power of the lighting load. Vs is ac mains voltage vector; Va is auxiliary voltage vector inserted by the dimming device and VL is the resultant voltage vector for the load. Ia is the current vector of the dimming device and is kept perpendicular to the auxiliary voltage (ie it is 90 or 270 degrees out of phase with Va). $I_L$ is the load current and is equal to Ia.

The power flow diagram of an embodiment of the invention is shown in FIG. 4(*b*). By inserting an auxiliary voltage vector Va through the use of a reactive-power control circuit, the resultant voltage $V_L$, which is the vectorial difference of the supply voltage vector Vs and the auxiliary voltage vector Va, can be controlled. Because the generation of Va is done by dealing with the reactive power Q, the dimming device theoretically does not handle any real power P of the lighting load. The only practical loss in the dimming device is the conduction loss and switching loss in the power circuitry of the dimming device. As shown later in the measurements of a number of experimental examples, the total loss of the dimming device is typically less than 10% of the saved lamp power in the dimming process. For example, if the lamp power of 150 W in a discharge lamp is dimmed to 80 W, the lamp power reduction is 70 W and the dimming device will consume less than 7 W. Consequently, a real energy saving of 63 W is achieved in this example.

FIG. 4(*c*) shows the equivalent circuit of an embodiment of the invention. Based on the power network theory, Vx is a controlled ac voltage source on the transmission end of the transmission network. This Vx is equivalent to the ac voltage (generated by the inverter bridge) before being filtered by the filter inductor LF. The auxiliary voltage Va (the filtered version of Vx) is on the receiving end of the network. The magnitude and phase shift δ of Vx is controllable.

The real power P and the reactive power Q supplied to the circuit can be shown to be:

$$P = \frac{V_a V_x}{\omega L_F}\sin\delta \tag{1}$$

$$Q = \frac{V_x^2}{\omega L_F} - \frac{V_a V_x}{\omega L_F}\cos\delta \tag{2}$$

where ω=2πf, f is the mains frequency, and δ is the angle between the voltage vectors Va and Vx.

From Equations (1) and (2) it can be seen how the voltage-vector generation and reactive-power control concept minimizes power loss in the dimming circuit. Equation (1) indicates that, by keeping δ zero, sin δ is zero and this P is equal to zero. So the dimming circuit will not consume real power of the power flow. Equation (2) shows that reactive power Q and the auxiliary voltage vector Va can be adjusted by controlling the magnitude of Vx. The magnitude of Vx can be controlled by regulating the dc link voltage Vdc of the inverter bridge in a closed-loop control scheme as will be explained further below.

Preferably, as will be described below, a voltage source inverter with a half bridge configuration is used in this embodiment of the invention with its dc side being supplied from two capacitors. The capacitor voltage of the inverter can be controlled with a closed loop control circuit by adjusting a DC voltage setting. The closed loop circuit will alter δ temporarily during this transition situation. If δ is positive, the capacitor voltage will be increased, and vice versa. The angle δ is kept zero after the capacitor voltage adjustment in the steady-state condition. This achieves the function of reactive power and voltage control.

Figure 5A:
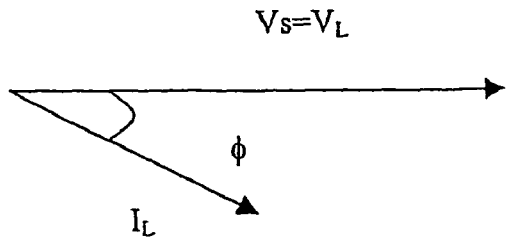
Figure 5B:
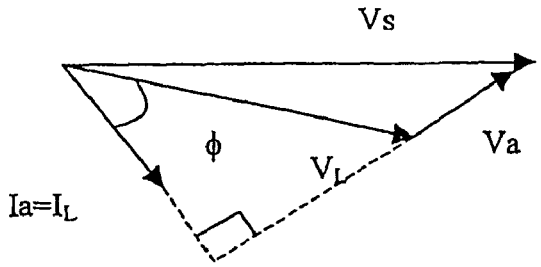

FIG. 5(*a*) shows a typical vector diagram of a magnetic ballast driven discharge lamp system without any dimming function (Vectors are assumed to rotate in the anticlockwise direction at the mains frequency.). In this case, Vs is simply equal to $V_L$. Because the magnetic ballast consists of a large inductor or choke and the lamp arc can be represented as a resistance, the circuit is highly inductive. Thus, the load current $I_L$ lags behind the supply voltage Vs by a phase angle ϕ. FIG. 5(*b*) shows the vector diagram if the dimming device of an embodiment of the present invention is included. The dimming device inserts (without dissipating a lot of power) a voltage vector Va to the system. The resultant load voltage available to the lighting system can be altered (made smaller) smoothly. As a result, the lamp power can be controlled by the voltage-vector concept. Comparing FIG. 5(*a*) (without dimming device) and FIG. 5(*b*) (with dimming device), the insertion of an auxiliary voltage vector Va to the mains voltage vector Vs can reduce the magnitude of the resultant voltage $V_L$. Hence, the magnetic ballast driven lighting system will have less current $I_L$ and the lamp power can be reduced.

Ia and the load current $I_L$ are identical in FIG. 5(*b*). From a consideration of FIG. 5(*b*) it can be seen that in principle the magnitude of the voltage applied to the load could be controlled by varying the magnitude and/or phase of the auxiliary voltage. However, it is greatly preferable to maintain the vector of the auxiliary voltage so as to be perpendicular to the vector of the current in order to minimize the power loss in the dimming device, therefore the current vector entering the dimming device (Ia=$I_L$) should preferably be kept 90 or 270 degrees out of phase with the auxiliary voltage vector (Va) generated by the dimming device. As the vectors Ia and Va are perpendicular to each other, the dimming device theoretically consumes no real power. In practice, the dimming device will consume a very small amount of power due to conduction loss, switching loss and magnetic loss in the dimming device. But the total power loss in the dimming device is only a small fraction (typically less than 10%) of the total saved lamp power.

Figure 6:
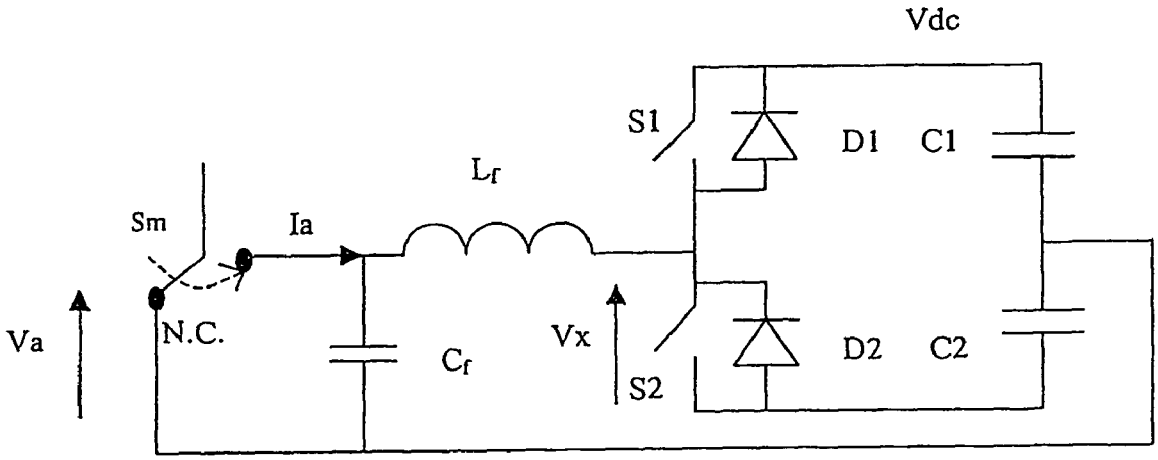
FIG. 6 is a schematic diagram showing the power electronic circuit of a dimming control apparatus according to an embodiment of the invention.

FIG. 6 shows the schematic of the power electronic circuit of a dimming device according to an embodiment of the invention. The device includes a by-pass switch Sm (e.g. an electro-mechanical switch such as a relay or a contactor) that is "normally closed" (N.C.) when the dimming circuit is not activated. Under this inactive operating mode (when the relay is closed), Ia bypasses the dimming circuit and Va is zero. Thus, the proposed dimming device is non-intrusive to the electric lighting system to be dimmed. When the dimming device is activated, Sm is opened and Ia will flow into the dimming circuit.

The circuit of the dimming device of this embodiment consists of a half inverter bridge with a pair of totem pole power electronic switches S1 and S2. The two capacitors (C1 and C2) serve as dc link bulk capacitors and energy storage capacitors. Through the two freewheeling diodes D1 and D2 and the switching actions of S1 and S2, DC voltage can be built up in the two series connected capacitors C1 and C2, when the dimming device is activated. The DC voltage across C1 and C2 provides a DC voltage source for the half inverter bridge. The two power electronic switches S1 and S2 in the half inverter bridge are high-frequency switched under a sinusoidal pulse-width-modulated (PWM) scheme in order to generate a PWM voltage waveform with a high-quality sinusoidal content. The PWM voltage waveform is then filtered by a low-pass filter comprising an inductor L and a capacitor C so that the high-frequency voltage harmonics in the PWM votlage waveform are filtered. The filtered voltage is then a high-quality sinsoidal voltage, which is the auxiliary voltage Va generated by the dimming device.

Figure 12:
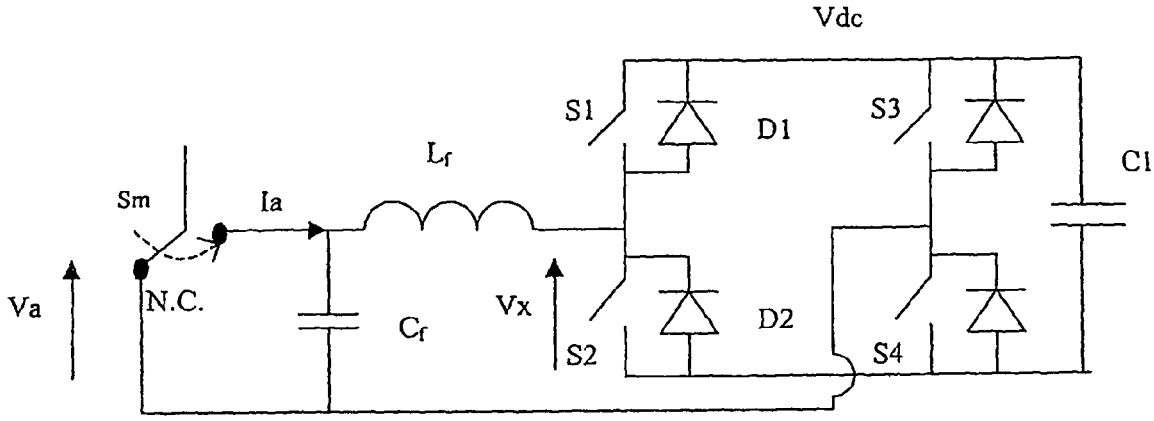
FIG. 12 shows an alternative embodiment that uses a full-bridge inverter to generate the auxiliary voltage.

It should be noted that a full-bridge inverter can also be used to replace the half-bridge inverter as shown in FIG. 12.

However, a half-bridge inverter uses half of the number of power electronic devices of the full-bridge counterpart and is therefore a more cost-effective solution. For low power applications (eg less than 2 kVa) a half-bridge inverter is sufficient. But for high power applications a full bridge inverter is more appropriate.

When activated, the dimming circuit starts its operation by opening the normally closed bypass switch Sm. The dimming level of the lighting load can be regulated using a closed-loop control scheme. The dimming level can be determined by setting a reference level for the DC link voltage (Vdc) of the half-bridge inverter. If this Vdc reference is set at zero, for example, the magnitude of the Va generated by the dimming circuit will be zero. If the Vdc reference is set at a certain level, then this Vdc will be the dc link voltage for the inverter and will affect the magnitude of the auxiliary voltage Va.

The PWM voltage generated by half-bridge inverter will have a peak-to-peak magnitude of +0.5 Vdc and −0.5 Vdc. In the closed-loop control, the phase angle between the mains voltage Vs and the auxiliary voltage vector Va will be controlled in such a way that (1) the actual dc link voltage Vdc will be regulated according to its reference setting and (2) Ia (=IL) will be 90 or 270 degrees out of phase of Va. Condition (1) determines the magnitude of Va. Condition (2) makes sure that the dimming circuit only handles reactive power (Q) of the lighting system. In this way, the power rating of the dimming circuit can be much smaller than that of the lighting system. Consequently, low-cost dimming circuit can be developed for dimming "non-dimmable" lighting system.

Figure 7:
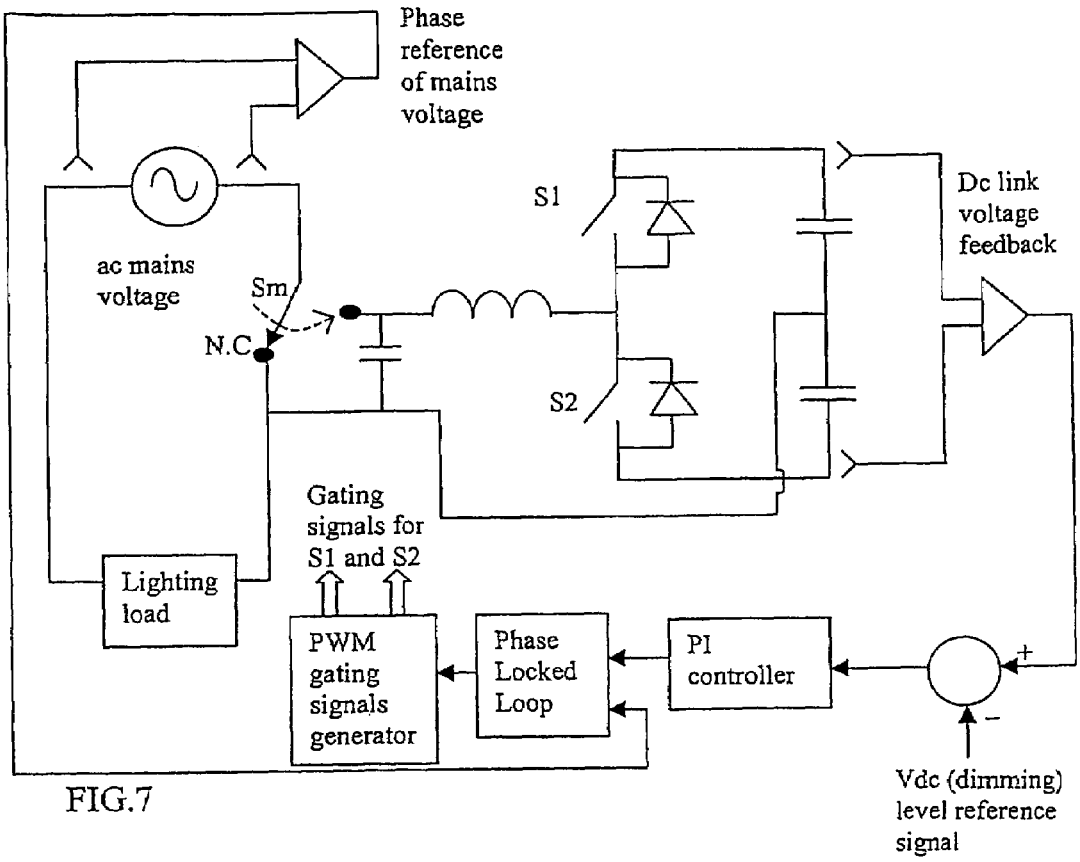
FIG. 7 illustrates a closed-loop control system for use in an embodiment of the present invention.

FIG. 7 shows a block diagram of the voltage-vector and reactive-power control scheme for the dimming device. As discussed with reference to FIG. 6 a normally-closed (N.C.) electro-mechanical switch (typically a relay or a contactor) is used as a bypass switch if the dimming circuit is not activated. Once the dimming circuit is activated, the N.C. switch will be connected to the circuit as shown in FIG. 7. One sensor (typically a signal transformer) is used to sense the mains voltage so that the phase of Vs can be obtained. Another sensor is a dc voltage sensor (typically a potential divider) for detecting the dc link voltage Vdc of the inverter-bridge in the dimming circuit. The dimming control is controlled in the form of a dc voltage (Vdc) reference. A comparator is used to derive the error signal between the Vdc reference and the Vdc feedback signal. The error signal is fed to an error compensator or typically a proportional-integral (PI) controller, which generates a phase shift signal. With the phase shift signal and the phase reference of the mains voltage as inputs, a phase locked loop is used to generate pulse-width-modulated (PWM) gating signals to the power switches S1 and S2 so that the auxiliary voltage vector Va will have appropriate phase shift with the mains voltage vector Vs in order to keep the dc link voltage Vdc at the Vdc reference level. By keeping Vdc at the required reference level, there is no net real power consumption in the dimming circuit. Hence, this control scheme has the automatic feature that the auxiliary voltage vector Va is perpendicular to the input current Ia of the dimming circuit. In other words, the proposed control scheme ensures that the dimming circuit generates the required auxiliary voltage vector by handling reactive power only. The power ratings of the dimming circuit can therefore be designed according to the reactive power of the lighting load and not the full power of the lighting load.

Figure 8:
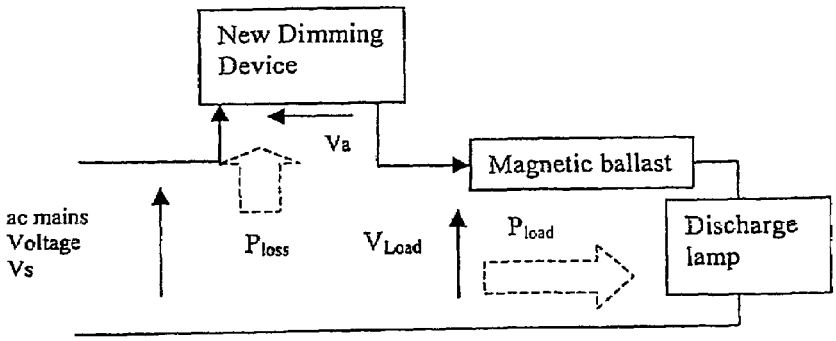
FIG. 8 is a block diagram illustrating an experimental set-up, FIGS. 9(*a*)-(*f*) show experimental results, FIGS. 10(*a*) and (*b*) show measurements of (a) real power consumption of the load against voltage in one experimental example, FIGS. 11(*a*) and (*b*) show measurements of (a) real power consumption of the load against voltage in another experimental example, and (b) total power loss in the dimming control apparatus.
Figure 9A:
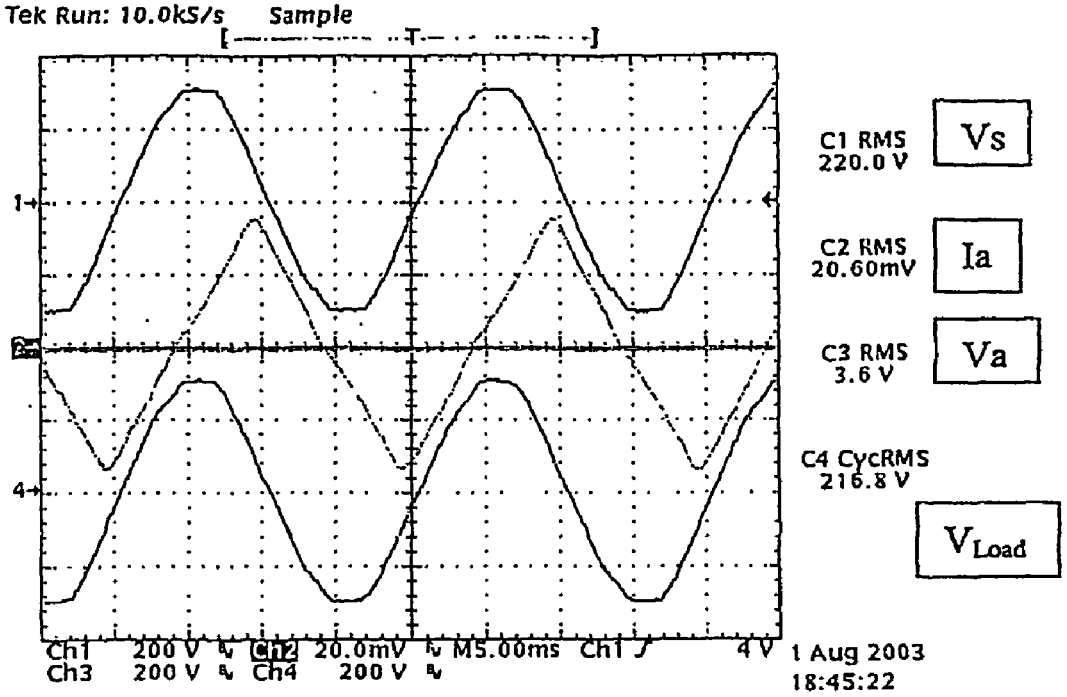
Figure 9B:
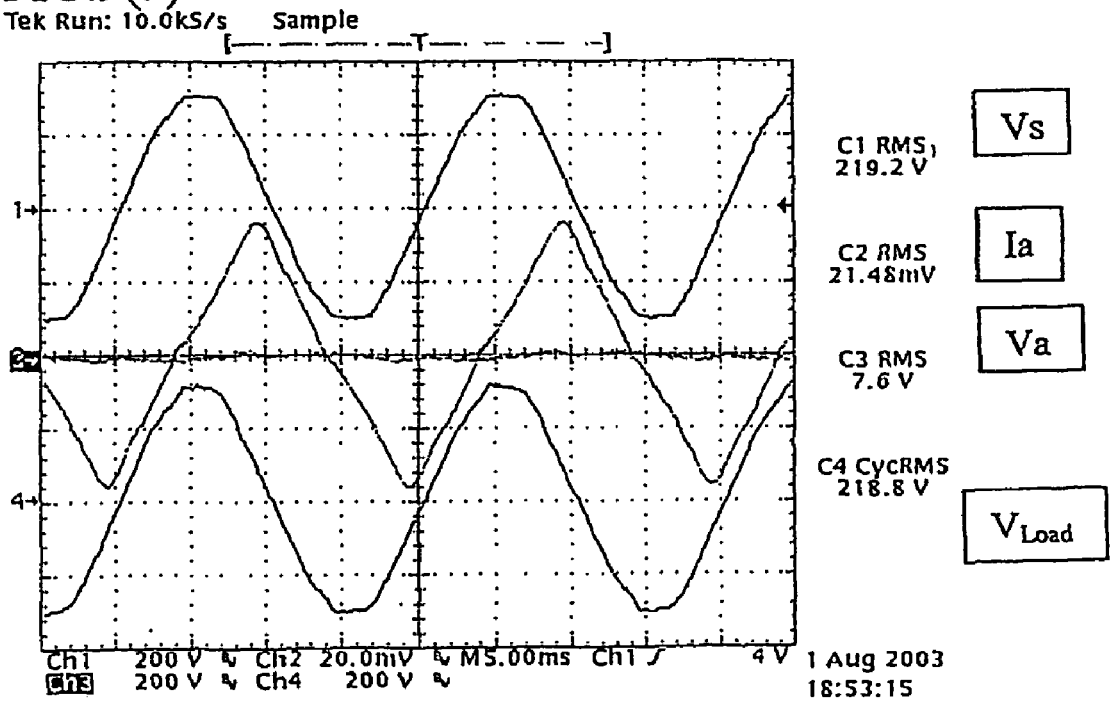
Figure 9C:
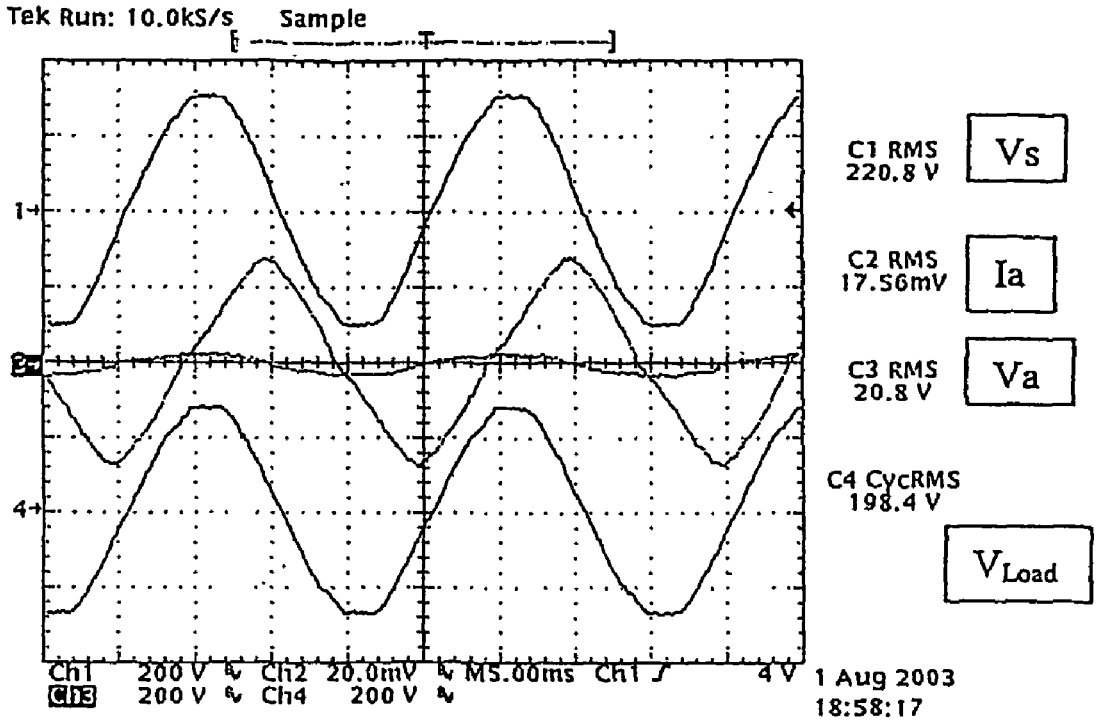
Figure 9D:
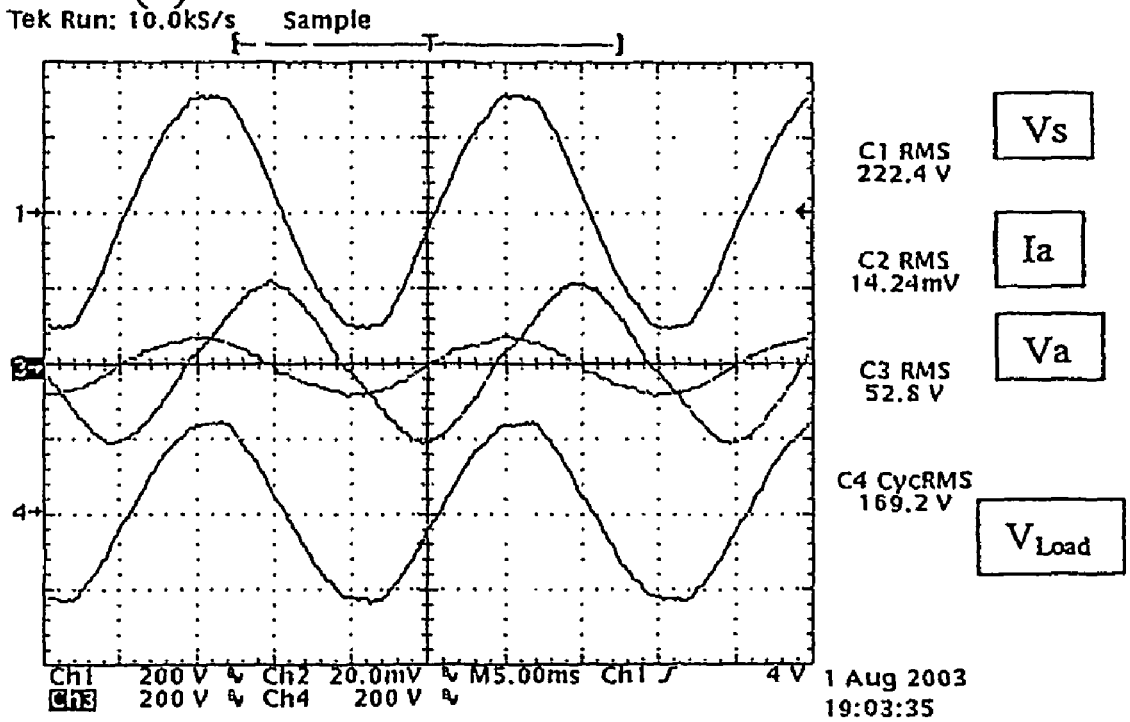
Figure 9E:
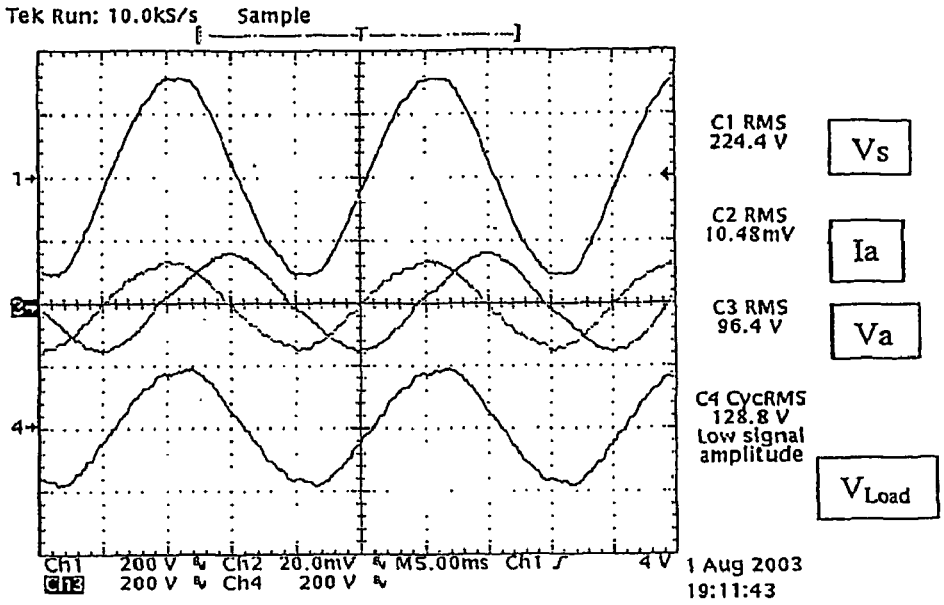
Figure 9F:
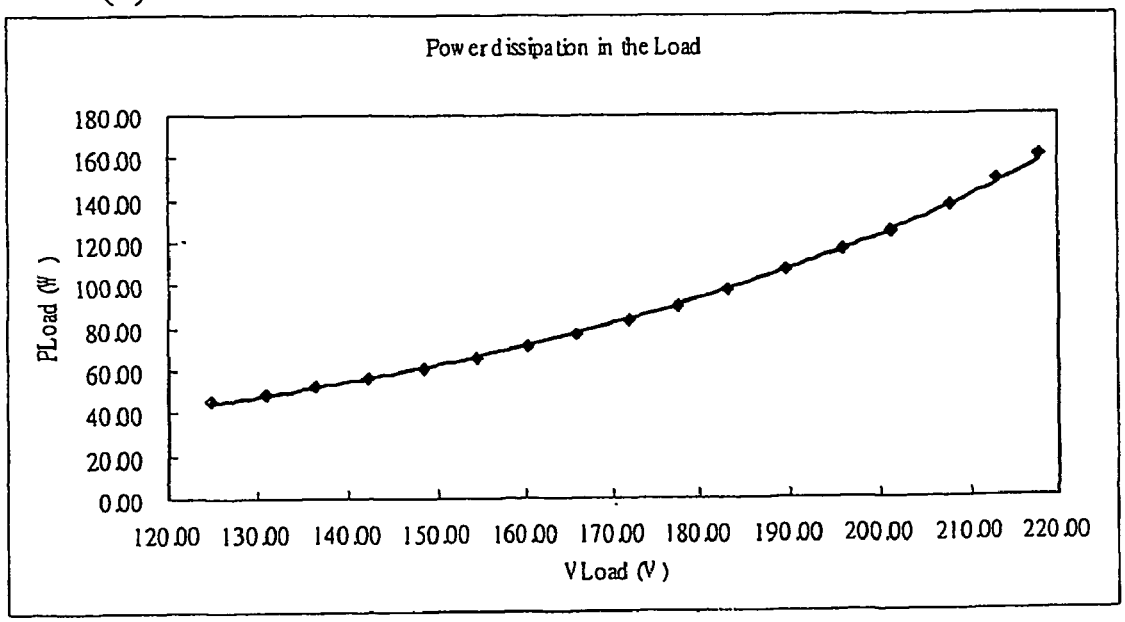

The proposed dimming method and apparatus has been tested with an experimental prototype and several discharge lamps driven by magnetic ballasts have been successfully dimmed. FIG. 8 shows the block diagram of the experimental setup. For a range of discharge lamps, the dimming device is connected to the magnetic ballast-discharge lamp system as shown in FIG. 6.

Tests were carried out to confirm the new dimming concept. By increasing the reference setting for Vdc, the dc link voltage is regulated to different levels in order to generate an auxiliary voltage Va. The mains voltage was 220V at 50 Hz. The mains voltage Vs, auxiliary voltage Va, the resultant voltage ($V_{Load}$) available to the lighting load, and the load current $I_L$ (same as Ia) were measured. The total input power ($P_{Load}$) consumed by the lighting load and the total power loss in the new dimming device were also measured.

FIGS. 9(*a*)-(*e*) show the measurements of a 150 W high-pressure sodium discharge lamp driven by a magnetic ballast. This system was dimmed by the new dimming device.

FIG. 9(*a*) shows the measured Vs, Ia, Va and $V_{Load}$ ($V_L$) when the bypass relay switch Sm is normally closed and the dimming circuit is not activated. The lamp operates at full power and it can be seen that $V_{Load}$ is equal to Vs, and Va is zero because Sm is closed.

FIG. 9(*b*) shows the measurements when the bypass relay is opened and the dimming circuit is activated with a very small (almost zero) dimming setting. It can be observed that Va is only 7V and that Vs is almost the same as $V_{Load}$. The lamp operates almost at full power.

FIG. 9(*c*) shows the measurements when the sodium discharge lamp is dimmed to about 75% of the full power. The auxiliary voltage is about 20V and $V_{Load}$ is now 198V. Compared with the load current Ia in FIG. 9(*a*) and FIG. 9(*b*), the load current Ia in FIG. 9(*c*) is reduced, confirming the reduction of the lamp power and the proposed dimming principle. It is important to note from FIG. 9(*c*) that Va and Ia are 90 degrees out of phase with each other, confirming that the dimming circuit essentially handles only reactive power. Test results for the lamp power dimmed down to 50% and 30% of the full lamp power are recorded in FIG. 9(*d*) and FIG. 9(*e*), respectively.

From FIGS. 9(*a*)-(*e*) it is clearly demonstrated that (i) a voltage vector Va with increasing magnitude can reduce the resultant voltage $V_{Load}$ for the lighting load and (ii) Va and Ia can be kept out of phase by 90 degrees. FIG. 9(*f*) shows the measurements of the actual real power consumption (P) of the lighting load (including both magnetic ballast and the sodium discharge lamp). The integrated voltage-vector control and reactive-power control concept for dimming purposes is practically confirmed and demonstrated.

Figure 10A:
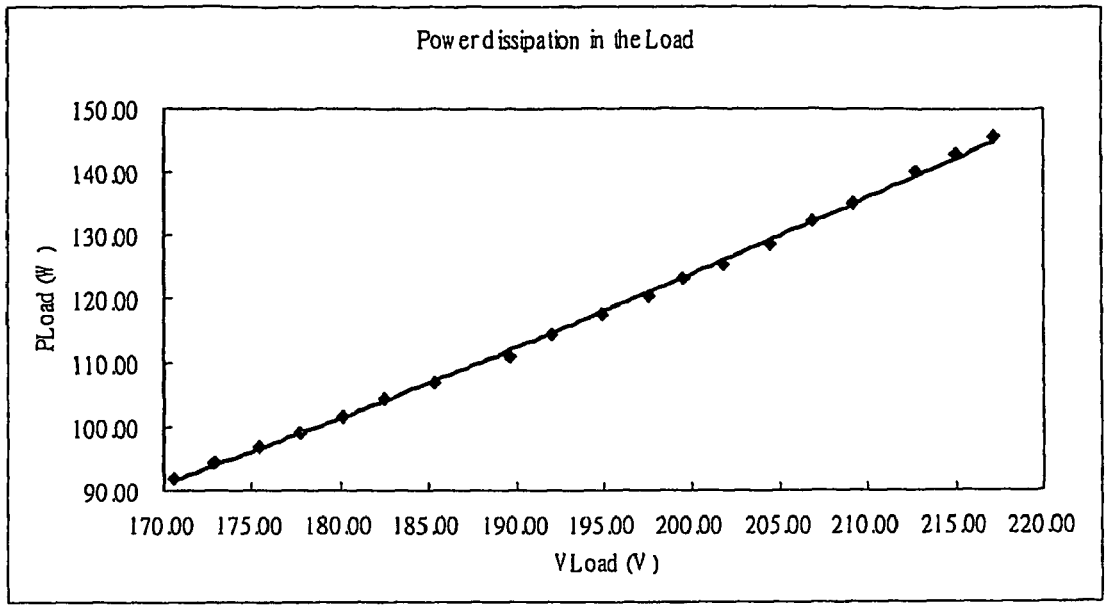
Figure 10B:
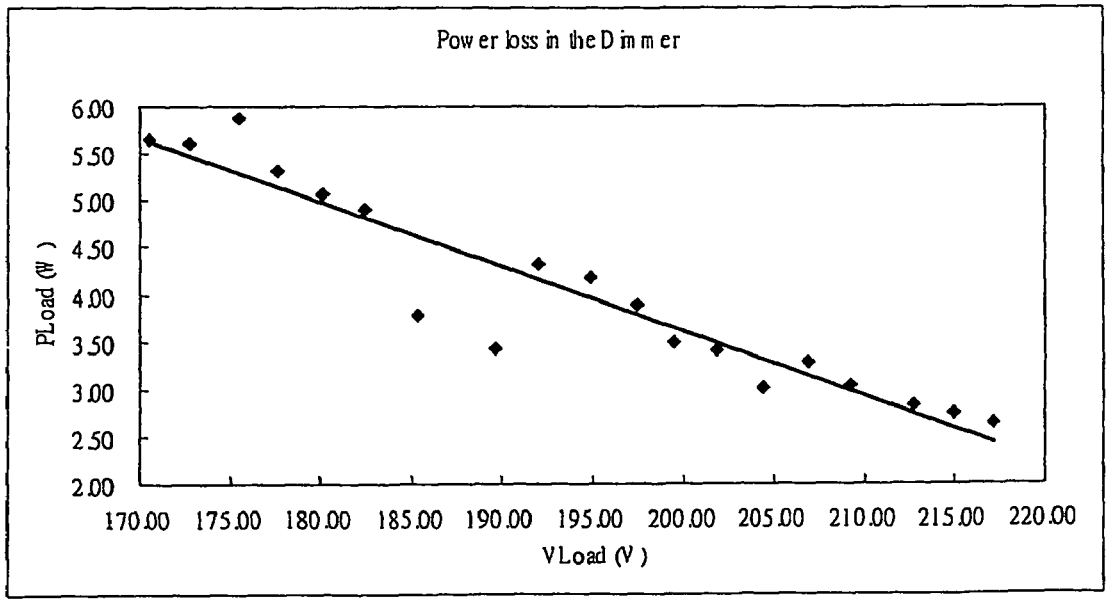

A Philips Mastercolour (CDM-T 150 W/830) 150 W metal-halide lamp was also tested with the new dimming device. The Philips 150 W Metal-Halide lamp is driven by a Philips (BSN 150L 407 I TS) magnetic ballast. FIG. 10(*a*) shows the measurements of the real power consumption of the lighting load over a dimming range. The real power loss dissipated in the new dimming device over the same dimming range was recorded and plotted in FIG. 10(*b*). When the lamp power is reduced from 150 W to about 92 W (i.e. a power saving of 58 W), the dimming device consumes only less than 6 W. This results in a real power saving of 52 W. In other words, the dimming device consumes only about 10% of the saved lamp power.

Figure 11A:
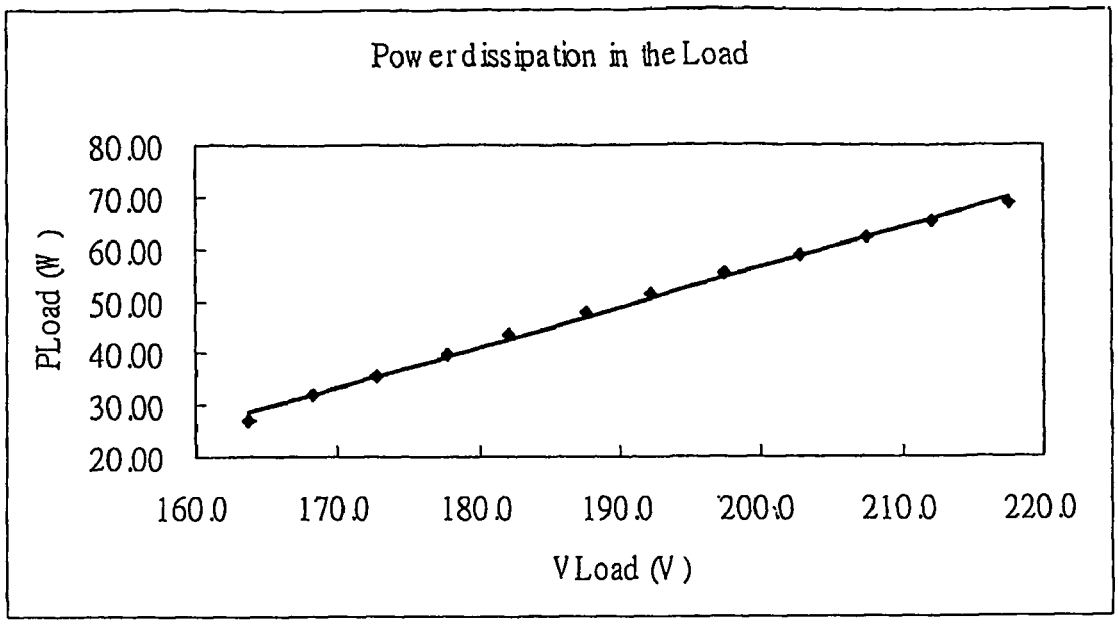
Figure 11B:
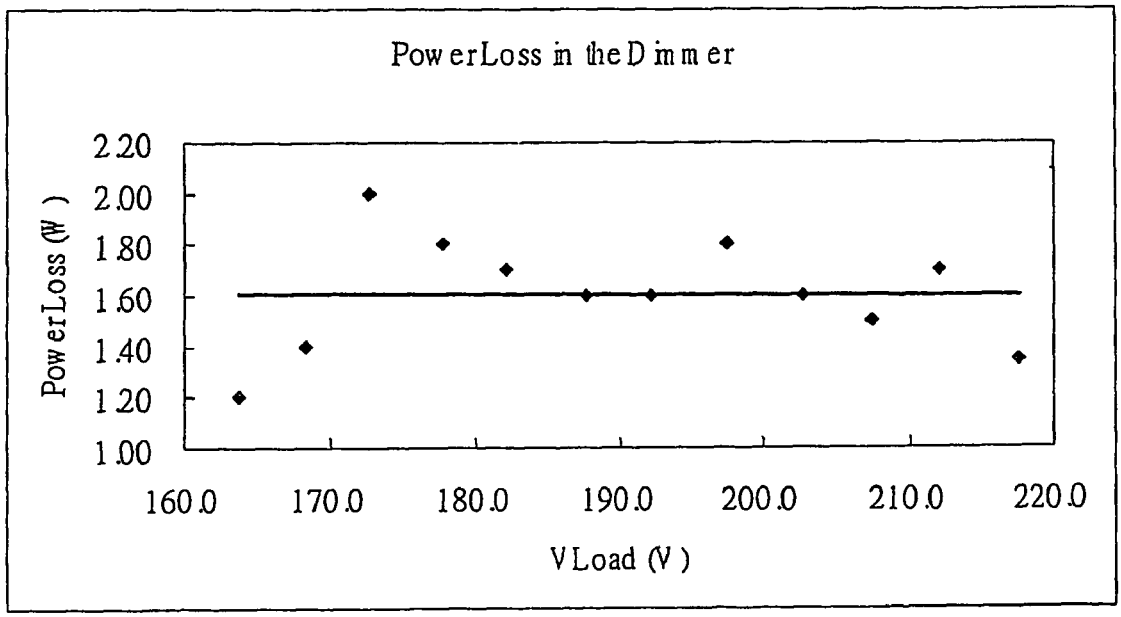

The results based on the 150 W Sodium discharge lamp and 150 W Metal-Halide lamp confirm that at least in preferred embodiments the invention is a highly energy-efficient way of dimming a normally "non-dimmable" lighting system. The dimming device has also been tested successfully to dim two sets of 2×36 W T8 fluorescent lamps driven by two conventional magnetic ballasts from 100% to about 40% of full lamp power. FIG. 11(*a*) and FIG. 11(*b*) shows the measurements of the total lamp power in a 2×36 W T8 lamp system (one lamp is a Philips TLD 36 W/33 Cool White and the other lamp is TLD 36 W/54 Day Light) powered by a Philips magnetic ballast and the 2×36 W lamp system is dimmed by the proposed dimmer. At full load, the lamp system consumes about 70 W. Within the dimming range from 100% to 40% (30 W) of the full power, the total loss in the dimmer is less than 2 W.

Figure 13:
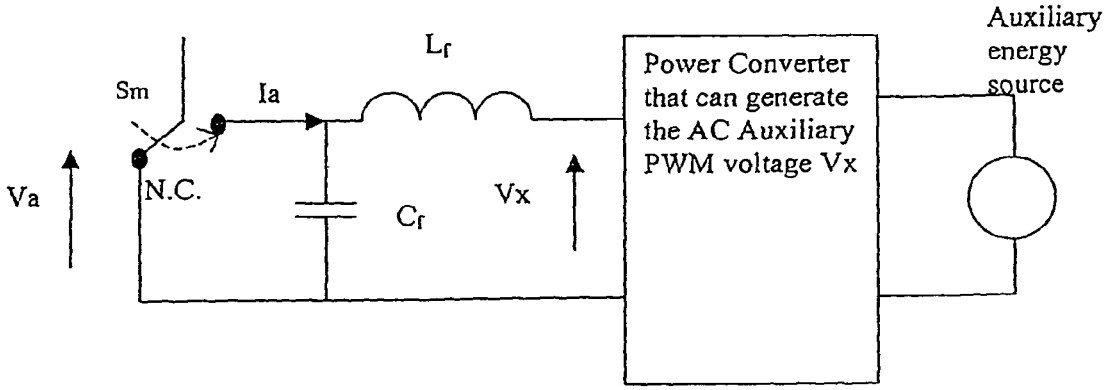
FIG. 13 shows an alternative embodiment in which a separate energy source is used for the auxiliary voltage.

In the embodiments described above no separate energy source is required for the generation of the auxiliary voltage. However, if desired an auxiliary energy source could be used as illustrated in FIG. 13. If the auxiliary energy source is an AC voltage, then an AC-AC power converter can be used to generate Vx. If the auxiliary energy source is a DC voltage, then an DC-AC power converter (such as the half-bridge power inverter or full-bridge power inverter) can be used to produce Vx.

The invention can also be applied to certain electronic ballasts for discharge lamps provided that the electronic ballasts are of a type that can be dimmed by reducing the ac input voltage to the ballasts.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

The invention claimed is:

1. Apparatus for providing dimming control of an electrical lamp of the type driven by a ballast that is provided between an AC supply and the lamp, comprising means located in series between the AC supply and the ballast for inserting an auxiliary voltage, said auxiliary voltage being out of phase with said AC supply, whereby the supply voltage is the vectorial combination of a voltage applied to the ballast and the auxiliary voltage, such that the magnitude of the voltage applied to the ballast is smaller than the magnitude of the voltage of the AC supply, and further comprising means for controlling the auxiliary voltage for varying the voltage applied to the lamp, wherein the phase of the auxiliary voltage is maintained 90 or 270 degrees out of phase with a current flowing through said apparatus, and wherein the magnitude of the auxiliary voltage is used for varying the voltage applied to the lamp.

2. Apparatus as claimed in claim 1 wherein said means for inserting an auxiliary voltage comprises a power converter for generating said auxiliary voltage.

3. Apparatus as claimed in claim 2 wherein said power converter comprises a half-bridge inverter comprising two switches that are switched at high-frequency to generate a pulse-width-modulated (PWM) waveform as an output.

4. Apparatus as claimed in claim 3 wherein the PWM output of said half-bridge inverter is filtered to provide said auxiliary voltage.

5. Apparatus as claimed in claim 3 further comprising means to select a desired DC link voltage for the half-bridge inverter in order to control the magnitude of the auxiliary voltage.

6. Apparatus as claimed in claim 5 further comprising means to maintain said DC link voltage at a desired value.

7. Apparatus as claimed in claim 6 wherein a closed loop control scheme is used for maintaining said DC link voltage at said desired value and for maintaining the phase of said auxiliary voltage 90 or 270 degrees out of phase with said current.

8. Apparatus as claimed in claim 2 wherein said power converter comprises a full-bridge inverter.

9. Apparatus as claimed in claim 1 further comprising switch means whereby said apparatus may be by-passed if dimming control is not required and the voltage of the AC supply is applied directly to the ballast.

10. An electrical lighting system comprising at least one lamp connected to an AC supply through a ballast, said system further comprising means for providing dimming control of said at least one lamp, said dimming control means comprising means located in series between the AC supply and the ballast for inserting an auxiliary voltage, said auxiliary voltage being out of phase with said AC supply, whereby the supply voltage is the vectorial combination of a voltage applied to the ballast and the auxiliary voltage, whereby the voltage applied to the ballast has a magnitude that is smaller than the magnitude of the voltage of the AC supply, and further comprising means for controlling the auxiliary voltage for varying the voltage applied to the lamp, wherein the auxiliary voltage is maintained at 90 or 270 degrees out of phase with a current flowing through said dimming control means, and wherein the magnitude of the auxiliary voltage is used for varying the voltage applied to the lamp.

11. A system as claimed in claim 10 wherein said dimming control means comprises a power converter for generating said auxiliary voltage.

12. A system as claimed in claim 11 wherein said power converter comprises a half-bridge inverter comprising two switches that are switched at high-frequency to generate a pulse-width-modulated (PWM) waveform as an output.

13. A system as claimed in claim 12 wherein the PWM output of said half-bridge inverter is filtered to provide said auxiliary voltage.

14. A system as claimed in claim 12 further comprising means to select a desired DC link voltage for the half-bridge inverter in order to control the magnitude of the auxiliary voltage.

15. A system as claimed in claim 14 further comprising means to maintain said desired DC link voltage.

16. A system as claimed in claim 15 wherein a closed loop control scheme is used for maintaining said DC link voltage at said desired value and for maintaining the phase of said auxiliary voltage 90 or 270 degrees out of phase with said current.

17. A system as claimed in claim 11 wherein said power converter comprises a full-bridge inverter.

18. A system as claimed in claim 10 further comprising switch means for bypassing said dimming control means if dimming control is not required and the voltage of the AC supply is applied directly to the ballast.

19. A system as claimed in claim 10 wherein said ballast is a magnetic ballast.

20. A system as claimed in claim 10 wherein said ballast is an electronic ballast of the type that enables a light to be dimmed by reduction of the AC input voltage to the ballast.

21. A system as claimed in claim 10 wherein said at least one lamp comprises a plurality of lamps.

22. A method for providing dimming control of an electrical lamp driven by a ballast, comprising inserting an auxiliary voltage between an AC supply and said ballast, said auxiliary voltage being out of phase with the voltage of said AC supply whereby the supply voltage is the vectorial combination of a voltage applied to the ballast and the auxiliary voltage, wherein the auxiliary voltage is maintained 90 or 270 degrees out of phase with a current supplied to the ballast.

23. A method as claimed in claim 22 wherein the auxiliary voltage is generated by a power converter.

24. A method as claimed in claim 23 wherein said power converter comprises a half-bridge inverter including two switches that are switched at high frequency to generate a pulse-width-modulated (PWM) waveform as an output.

25. A method as claimed in claim 24 further comprising filtering the output of the half-bridge inverter to produce said auxiliary voltage.

26. A method as claimed in claim 24 wherein the magnitude of the auxiliary voltage is controlled by setting the DC link voltage of the half-bridge inverter.

27. A method as claimed in claim 26 further comprising maintaining the magnitude of the DC link voltage at a desired value.

28. A method as claimed in claim 23 wherein the power converter is a full-bridge converter.

* * * * *